US006386958B1

(12) United States Patent
Wang

(10) Patent No.: US 6,386,958 B1
(45) Date of Patent: May 14, 2002

(54) RECIPROCATING-TYPE ABRASIVE DEVICE FOR A SANDING MACHINE

(76) Inventor: Chun-Hsiang Wang, PO Box 82-144, Taipei (TW)

( * ) Notice: Subject to any disclaimer, the term of this patent is extended or adjusted under 35 U.S.C. 154(b) by 52 days.

(21) Appl. No.: 09/637,192

(22) Filed: Aug. 14, 2000

(51) Int. Cl.[7] ..... B24B 21/00; B24B 47/10
(52) U.S. Cl. ..... 451/65; 451/296
(58) Field of Search ..... 451/65, 304, 296, 451/157, 155, 57, 59, 489

(56) References Cited

U.S. PATENT DOCUMENTS 1,628,531 A * 5/1927 Carlson ..... 451/304
2,416,493 A * 2/1947 Newton ..... 451/296
4,939,870 A * 7/1990 Wang ..... 451/304
5,476,409 A * 12/1995 Wada et al. ..... 451/296

* cited by examiner

*Primary Examiner*—Robert A. Rose
(74) *Attorney, Agent, or Firm*—A & J

(57) ABSTRACT

A reciprocating-type abrasive device for a sanding machine is disclosed. In the present invention, one end of the support frame of the sanding module is provided with a driving roller having a motor, and the other end of the support frame is mounted with the reciprocating-type abrasive device having a driven roller, and the driven roller corresponds to the driving roller and both are surrounded by a sanding belt, and the reciprocating-type abrasive device comprises a driving structure and a reciprocating structure, and the reciprocating structure is mounted with a sanding wheel which reciprocates up and down by the driving structure, thereby the sanding wheel produces a reciprocating abrasive action and the entire sanding effect is improved.

8 Claims, 6 Drawing Sheets

RECIPROCATING-TYPE ABRASIVE DEVICE FOR A SANDING MACHINE

BACKGROUND OF THE INVENTION (a) Technical Field of the Invention

The present invention relates to reciprocating-type abrasive device for a sanding machine, and in particular, to a sanding machine having a sanding module mounted with the reciprocating-type abrasive device at one end thereof such that the sanding particles can provide a tangent-like abrasive effect to a corresponding material to upgrade entire sanding effect thereof (b) Description of the Prior Art As wood material generally has relatively large amount of fibers, the surface thereof has to be treated in order to give a smooth surface so as to add value to the products formed from the material. Besides the treatment of the surface of the material internal holes of the wood material may also need treatment, and therefore an inner hole treating mechanism is supplemented to the sanding machine. Referring to FIG. 1, there is shown a conventional sanding machine having a machine body 10 mounted with a working platform 15. One side of the platform 15 is provided with a sanding module 20 for the sanding of the surface of the wood material. The sanding module 20 has a support frame 21 with two ends respectively mounted with a driving roller 22 and a driven roller 23. The driving roller 22 is connected to a motor 24 to drive a sanding belt (not shown) mounted around the driving roller 22 and the driven roller 23. The inner hole sanding mechanism is mounted to the driving roller 22 by means of screw bolts 27 located on a shaft rod 26 having disposed with a sanding wheel 28 such that the sanding wheel 28 and the driving roller 22 rotate synchronously. That is, the rotation of the sanding wheel 28 is used to abrade the inner hole of the material.

However, the sanding wheel 28 of this conventional sanding machine provides a linear rotation, i.e., the position A on the sanding wheel 28 moves horizontally to the point A'. Thus, the material is polished in a linear manner. As the particles of the sanding wheel 28 contain very tiny gaps, the entire surface of the material cannot be polished. In other words, capillary holes on the surface of the material cannot be effectively removed. In addition, the entire surface will produce a "peak" or "valley" structure, and thus the surface of the material is rather rough. Additionally, the size of the material and the exertion force of the sanding wheel 28 on the material are not always constant, the exhaustion of particles of the sanding wheel 28 is not uniform. Thus, the surface of the sanding wheel 28 is irregular and the polished surface of the material will have similar irregularities, and the quality of the entire surface of the polished material is reduced. Therefore, it is an object of the present invention to provide a reciprocating-type abrasive device for a sanding machine, which can mitigate the drawbacks of the conventional sanding machine.

SUMMARY OF THE INVENTION

Accordingly, it is an object of the present invention is to provide reciprocating-type abrasive device for a sanding machine, wherein one end of the support frame of the sanding module is provided with a driving roller having a motor, and the other end of the support frame is mounted with the reciprocating-type abrasive device having a driven roller, and the driven roller corresponds to the driving roller and both surround a sanding belt, and the reciprocating-type abrasive device comprises a driving structure and a reciprocating structure, and the reciprocating structure is mounted with a sanding wheel which reciprocates up and down by the driving structure, thereby the sanding wheel produces a reciprocating abrasive action and the entire sanding effect is improved.

A further object of the present invention is to provide a reciprocating-type abrasive device for a sanding machine, wherein a reciprocating type sanding module is provided to the sanding machine, and a reciprocating rotational movement is produced by the sanding wheel so that the quality of the polished material is improved.

Other objects and advantages of the present invention will become more apparent from the following description taken in conjunction with the accompanying drawing.

DETAILED DESCRIPTION OF THE PREFERRED EMBODIMENT

Figure 1:
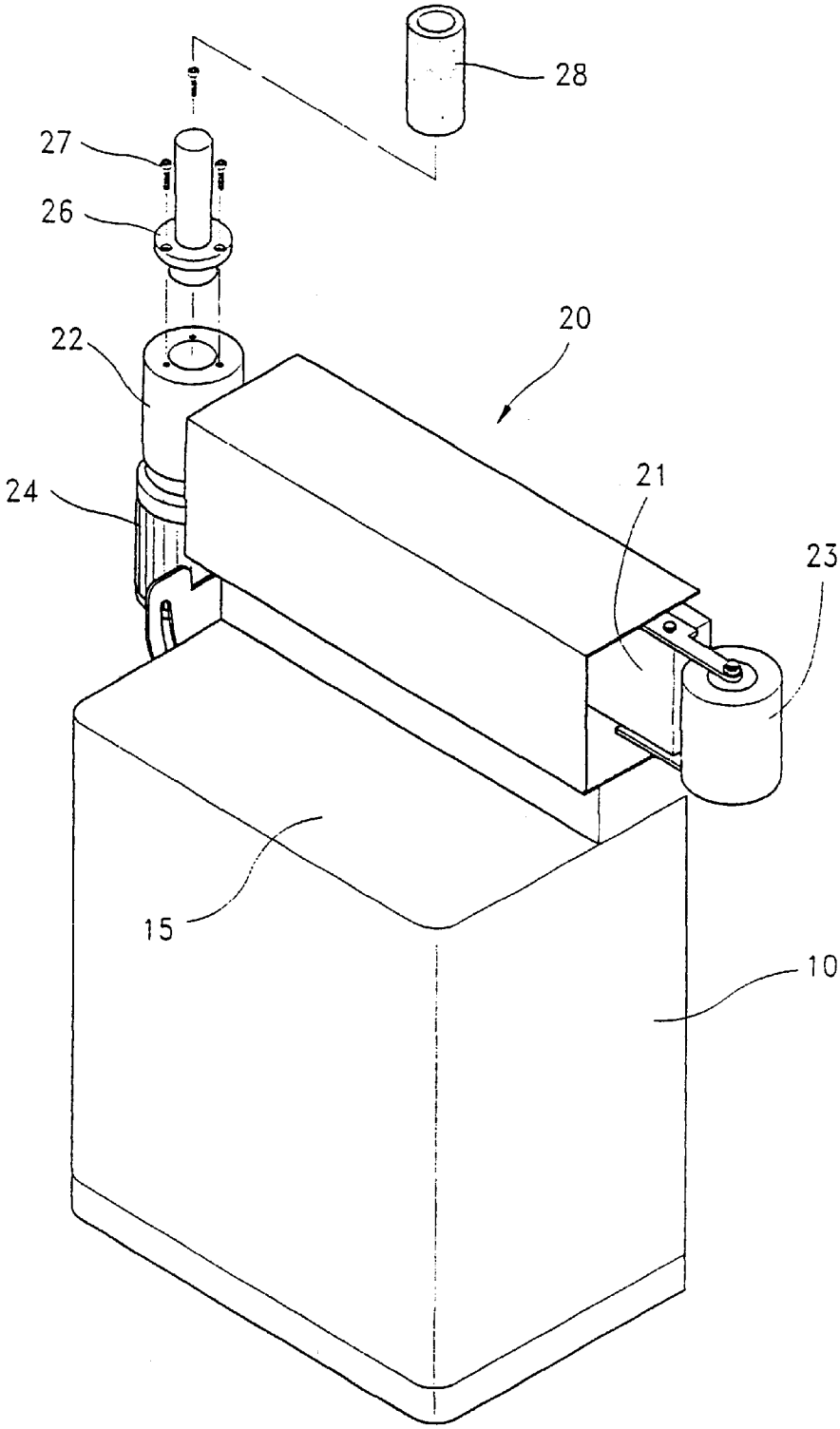
PRIOR ART FIG. 1
FIG. 1 is a partial exploded perspective view of a conventional sanding machine, illustrating the combination of the sanding wheel.
Figure 2:
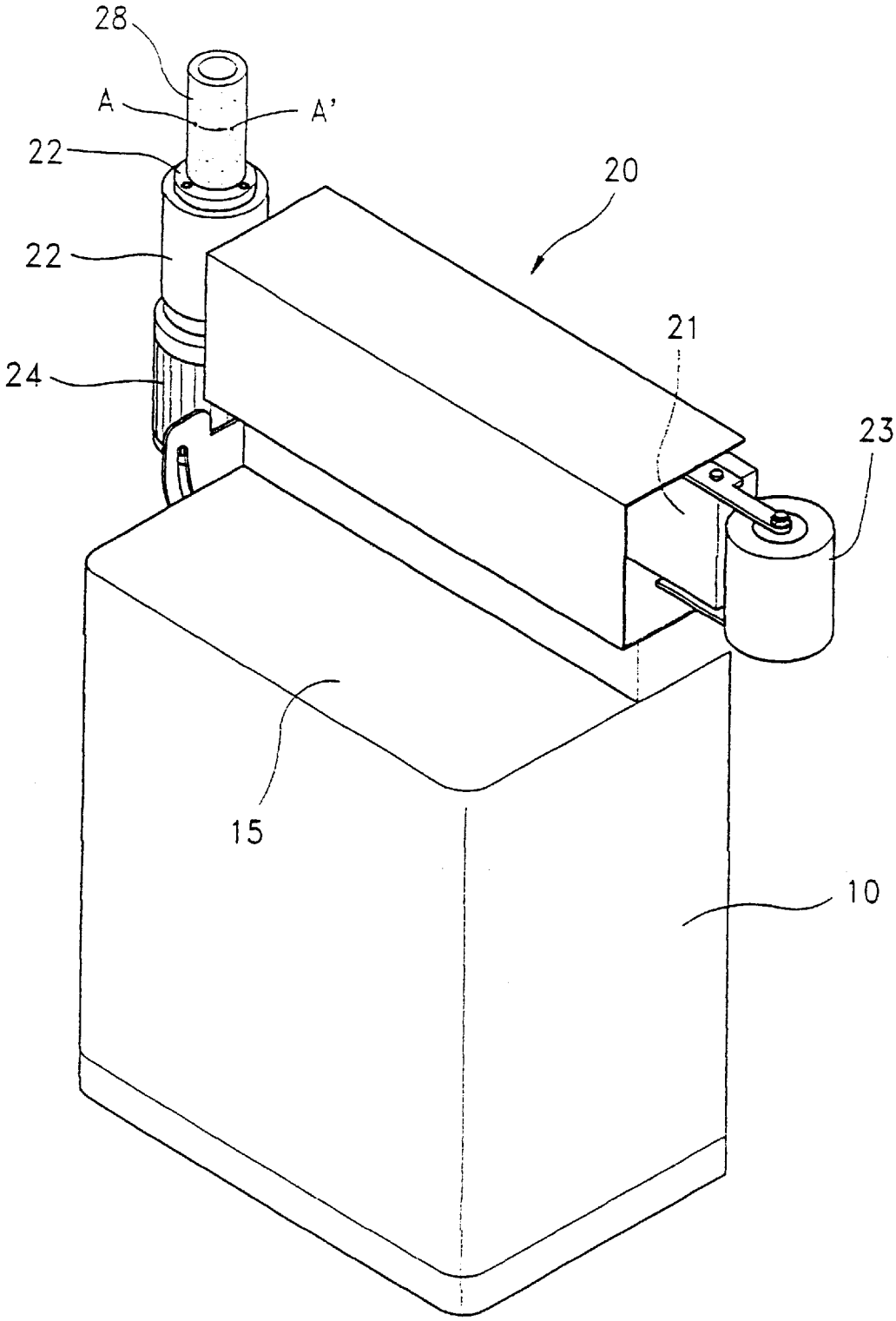
PRIOR ART FIG. 2
FIG. 2 is a perspective view of the conventional sanding machine, illustrating the operation principle and the entire structure of the sanding machine.
Figure 3:
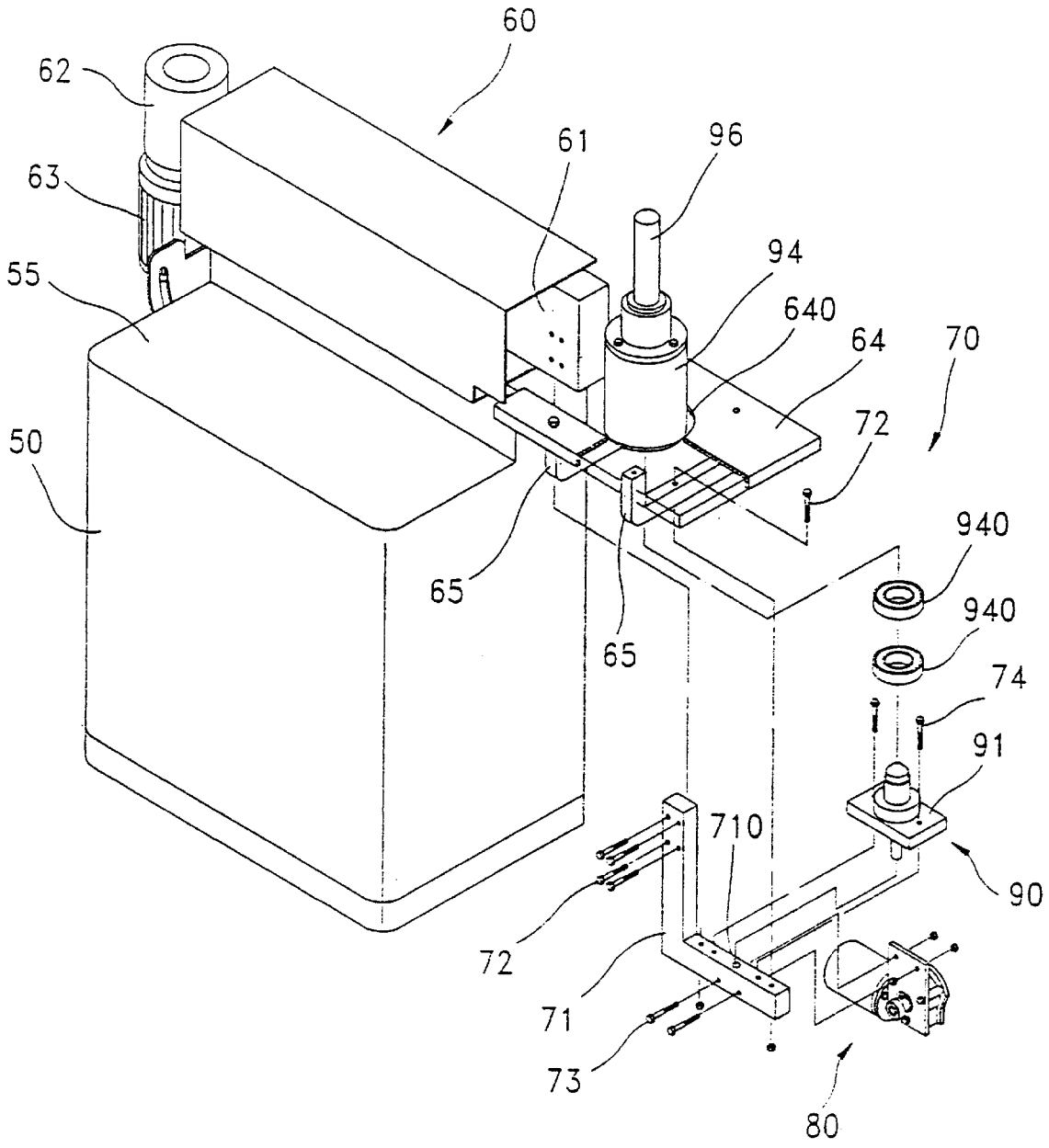
FIG. 3 is a perspective exploded view of the sanding machine, illustrating the main structure constituted the machine in accordance with the present invention.

Referring to FIG. 3, there is shown a reciprocating-type abrasive device for a sanding machine. The sanding machine has a machine body 50 having a working platform 55 at the top end. One side of the working platform 55 is mounted with an abrasive module 60 having a support frame 61 mounted with a driving roller 62 at one end of the frame 61. One end of the driving roller 62 is mounted with a motor 63 which is used to drive the driving roller 62. The other end of the support frame 61 is mounted with a reciprocating-type abrasive device 70 mounted with a driven roller 94.

The driven roller 94, corresponding to the driving roller 62, can correspondingly be mounted with a sanding belt (not shown) to proceed with surface abrasion of material. The reciprocating-type abrasive device 70 comprises a driving structure 80 and a reciprocating structure 90, and the reciprocating structure 90 is provided with a sanding wheel 120 which is driven by the driving structure 80 to proceed with up-down reciprocation movement so as to proceed with inner hole abrasion of the material.

Referring to FIG. 3, the lower edge of one end of the driving roller 62 is provided with a fixing board 64 having an opening 640 for the passage of the driver roller 94. The lateral sides of the opening 640 of the bottom face of the fixing board 64 are respectively provided with a U-shaped rod frame 65, and the reciprocating-type abrasive device 70 is provided with a fixing rod 71. By means of a screw bolt 72, the fixing rod 71 is fastened to both the support frame 61 and the two rod frames 65. The driving structure 80 is mounted to the lateral wall of the horizontal section of the fixing rod 71 by screw bolts 73. The reciprocating structure 90 is mounted at the top face of the horizontal section of the fixing rod 71 by means of screw bolts 74. The middle section of the fixing rod 71 is provided with a hole 710 such that the driving structure 80 can activate the reciprocating structure 90.

Figure 4:
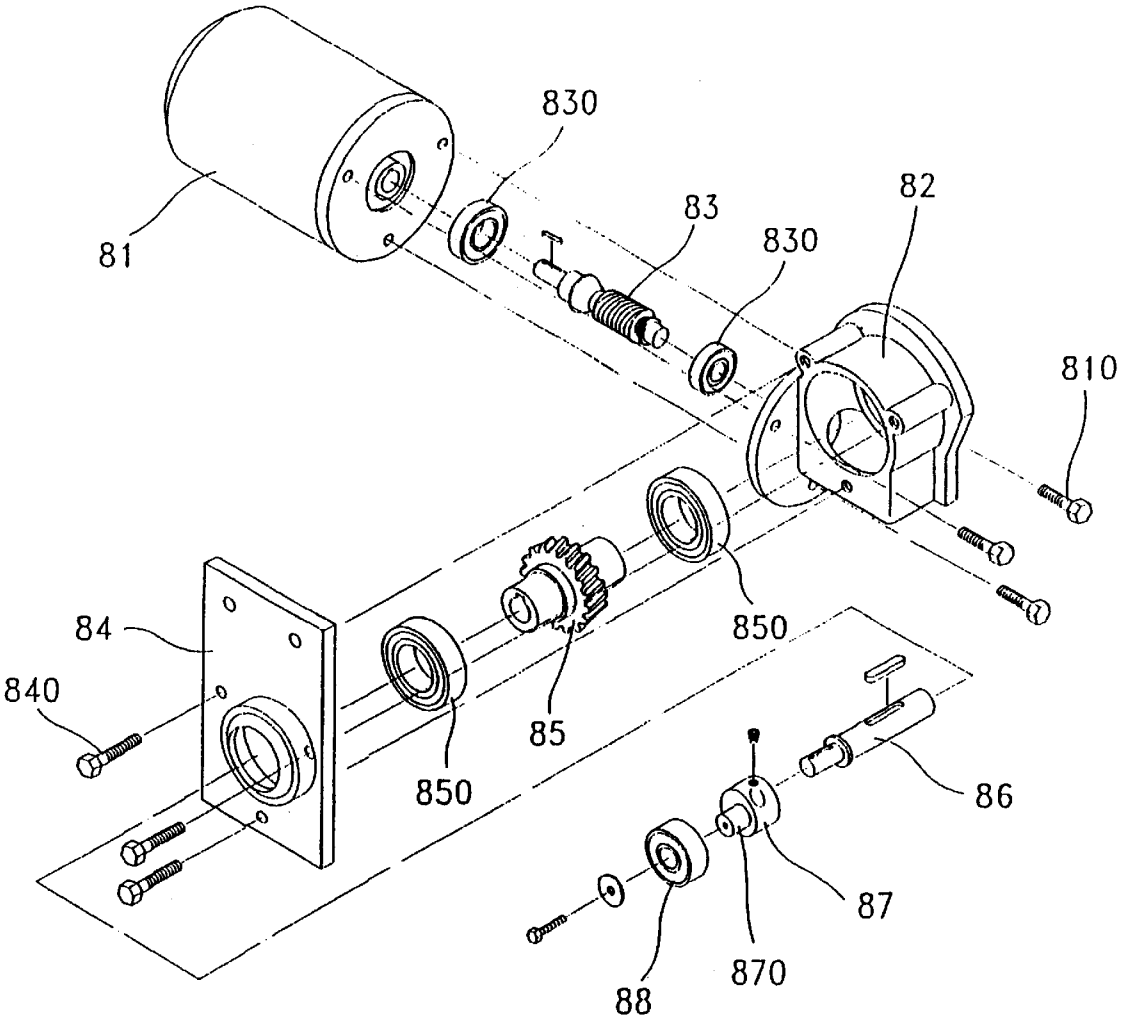
FIG. 4 is a perspective exploded view of the driving structure, illustrating the components of the driving structure in accordance with the present invention.

Referring to FIGS. 3 and 4, wherein the driving structure 80 is provided with a plurality of screw bolts 810 to fasten a housing 82 onto a servo-motor 81, and a bearing 830 is provided to the housing 82 and is used to connected to a worm 83 of the servo-motor 81. The lateral side of the housing 82 is mounted with a lateral covering plate 84 by means of screw bolts 840. A worm gear 85 with a bearing 850 is pivotally mounted between the lateral covering plate 84 and the housing 82, and the worm gear 85 and the worm 83 are in engagement with each other. One end of the worm gear 85 is provided with a main shaft 86 passing through the lateral covering plate 84. The free end of the main shaft 86 is mounted with a sleeve 87 having an eccentric protrusion 870, and a bearing 88 is mounted at the eccentric protrusion 870 to form the driving structure. After the lateral covering plate 84 is mounted to the fixing rod 71, the bearing 88 is corresponding to the hole 710 at the center of the fixing rod 71.

Figure 5:
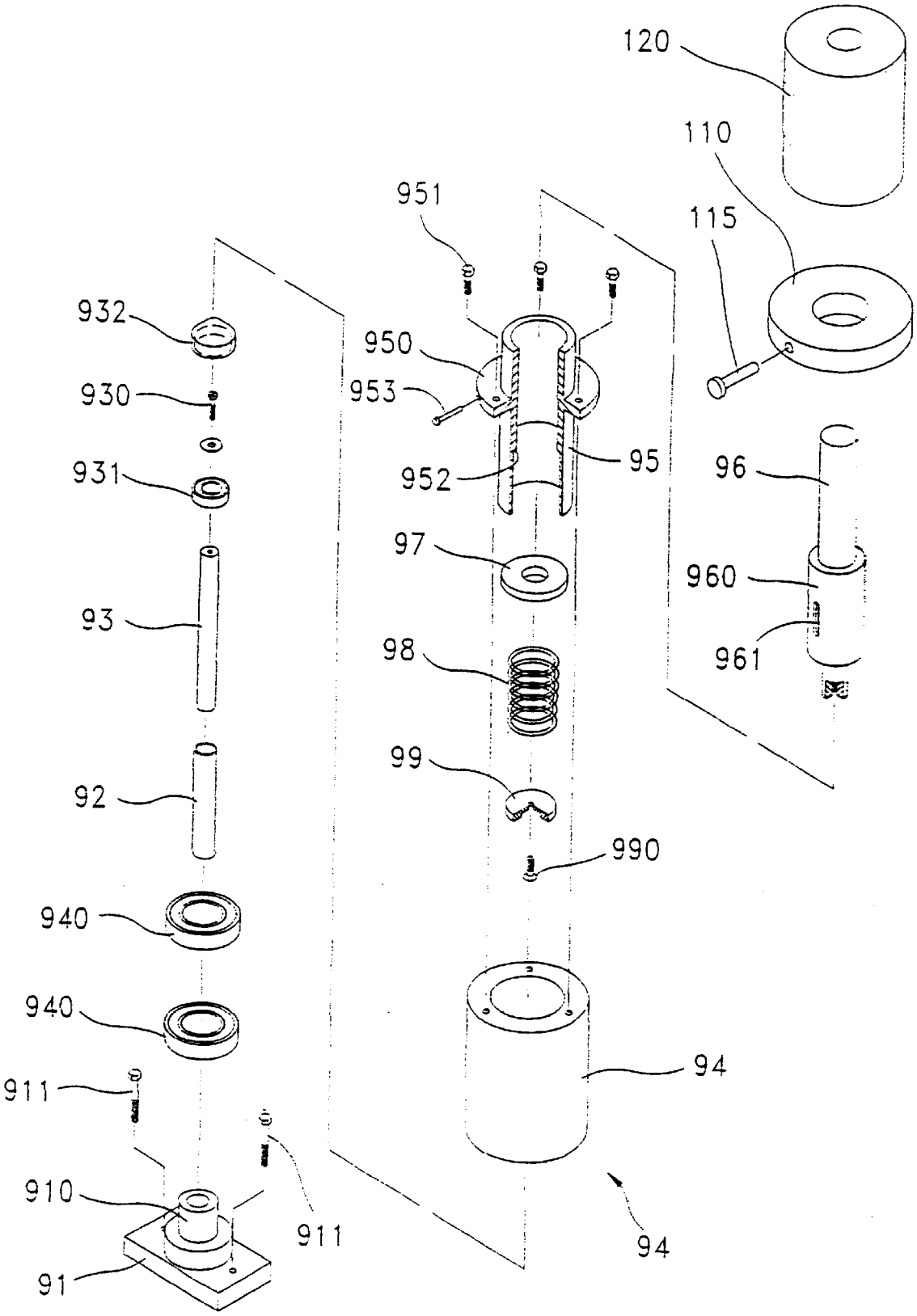
FIG. 5 is a perspective exploded view of the reciprocating structure, illustrating the components of the reciprocating structure in accordance with the present invention.
Figure 6:
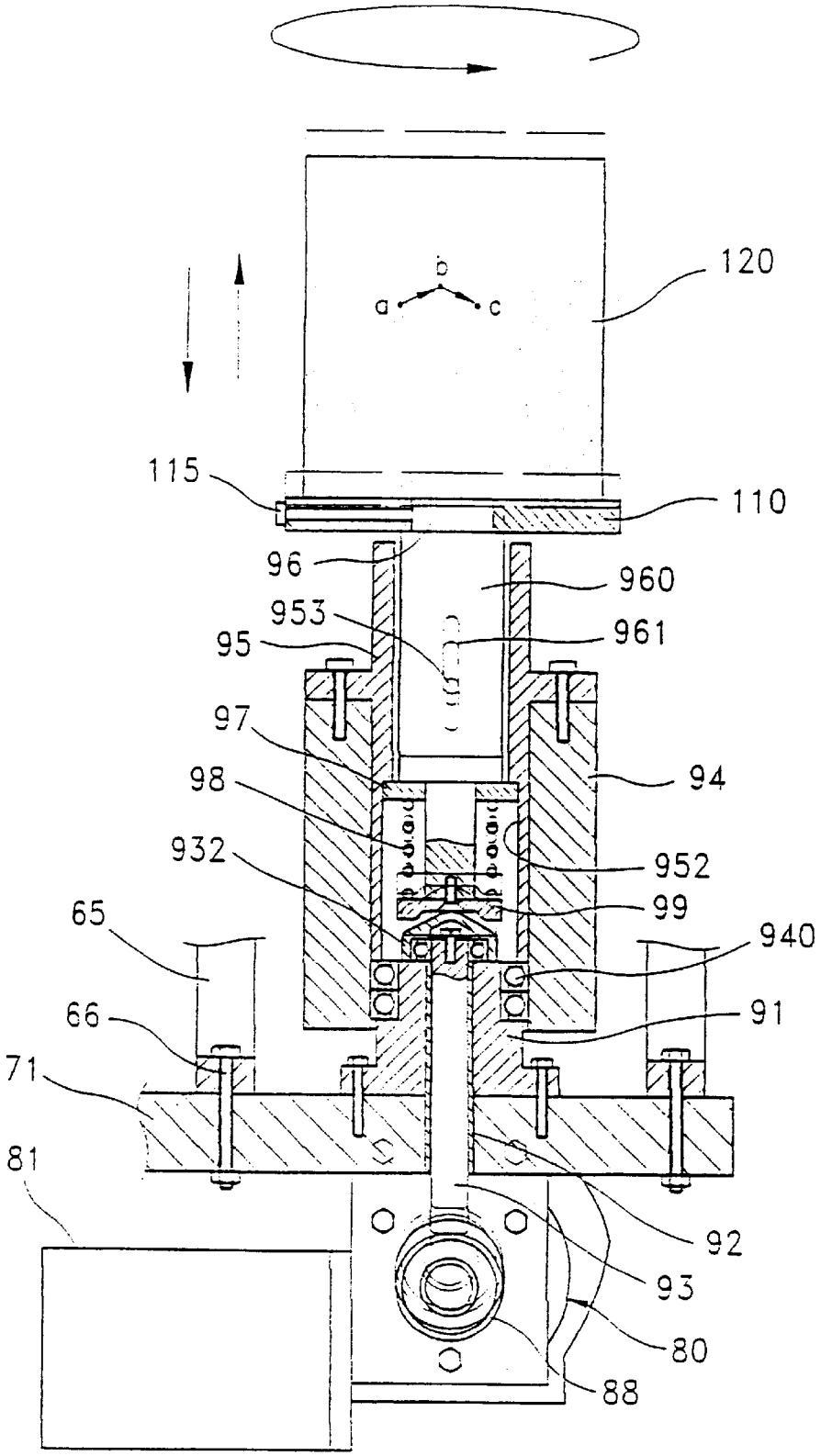
FIG. 6 is a sectional view, schematically showing the combination of the sanding machine in accordance with the present invention.

FIGS. 3, 5 and 6 show the reciprocating structure 90 of the present invention, wherein screw bolts 911 are used to fasten a seat body 91 on the fixing rod 71, and a step-like hollow protrusion 910 is formed on the seat body 91, and a mounting sleeve 92 is used to slidably insert a top support rod 93 within the protrusion 910. The top support rod 93 is protruded out from the hole 710 of the fixing rod 71, and the top end is locked with a bearing 931 by means of screw bolts 930. The bearing 931 is mounted with a sliding sleeve 932. The external edge of the protrusion 910 of the seat body 91 has two bearings 940 to pivotally mount the driven roller 94. A shaft sleeve 95 having a lip edge 950 is provided to the interior of the driven roller 94, and the screw bolts 951 are used to fasten the shaft sleeve 95 onto the driven roller 94.

The interior of the shaft sleeve 95 is provided with a tapered hole 952 and within the tapered hole 952, a main shaft rod 96 having a larger sliding shaft section 960 is mounted thereto. There is an axial sliding slot 961 on the sliding shaft section 960, and the shaft sleeve 95 is a positioning rod 953 which can be engaged with a sliding slot 961, such that the main shaft rod 96 slides up and down of the shaft sleeve 95. A pad 97 is mounted to the lower edge of the sliding shaft section 960 and is used to urge against with the shaft sleeve 95. The lower section of the pad 97 is provided with a spring 98. The bottom end of the main shaft 96 is provided with a limiting plate 99 mounted with screw bolts 990 for the urging with the spring 98 such that the main shaft rod 96 can urge against the sliding sleeve 932 of the top support rod 93. The top support rod 93 urges against the bearing 88 of the driving structure 80, and thus a reciprocating-type abrasive device having a sanding wheel 120 which reciprocates up and down is obtained.

The objectives and effectiveness of the present invention are described hereinafter. Referring to FIGS. 3, 4 and 6, when the reciprocating abrasive device is required to abrade the inner hole of the material, the servomotor 81 at the driving structure 80 is initiated. Thus, the servomotor 81 via the worm 83 and the worm gear 84 causes a transmission main shaft 86 to rotate such that the bearing 88 on the eccentric protrusion 870 to produce an eccentric rotation, and the top support rod 93 of the reciprocating structure 90 urges the bearing 88 which rotates eccentrically, and the main shaft rod 96 urges at the top end of the top support rod 93 by the spring 98, the top support rod 93 will move up and down in accordance with the eccentric rotation of the bearing 88, and in turn, the main shaft rod 96 is also moved up and down corresponding to the driven roller 94.

Accordingly, the sanding wheel 120 on the main shaft rod 96 will move up and down. At the same time, the driven roller 94 is driven by the driving roller 62 and the sanding belt, the driven roller 94 causes the main shaft rod 96 to rotate via the positioning rod 953 and the sanding wheel 120 also produces a reciprocating up and down rotational movement. This will cause the particles on the sanding wheel 120 to produce a tangential movement from point "a" towards point "b" and then to point "c". Therefore, the gaps on the sanding particles can be overcome, and the capillary holes on the surface of the material are effectively removed. At the same time, the "peak" and "valley" formed on the surface of the material by the sanding particles are also mitigated and the polished material becomes fine and smooth. Besides, due to the movement of the sanding particles, the exhaustion of the surface of the sanding wheel is comparatively uniform and in turn, the flatness of the sanding surface is greatly improved and the quality of the entire material is effectively upgraded.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A reciprocating-type abrasive device for a sanding machine having a machine body mounted with a sanding module at the top end of the machine body, the module being provided with a support frame having one end mounted with a driving roller having a driving motor, the other end of the support frame being a reciprocating-type sanding machine having a driven roller, the driven roller corresponding to the driving roller and both being surrounded by a sanding belt, the reciprocating-type abrasive device comprising a driving structure and a reciprocating structure, and the reciprocating structure mounted with a sanding wheel driven to reciprocate up and down by the driving structure, the reciprocating abrasive device disposed with a fixing rod mounted to the support frame, and the driving structure being mounted at the lateral wall of the horizontal section of the fixing rod, and the reciprocating structure being mounted at the top end of the horizontal section of the fixing rod, and a hole being formed on the middle section of the fixing rod such that the driving structure moves the reciprocating structure; and the driving structure using a servomotor to drive a main shaft having an eccentric protrusion at one free end thereof, a bearing corresponding to the fixing rod being mounted on the eccentric protrusion; the fixing rod being mounted onto the eccentric protrusion, the fixing rod mounted with a seat body having a hollow protrusion, and a top support rod being inserted within the hollow protrusion, the external edge of the protrusion being mounted with a hollow driven roller by means of a bearing, the driven roller being provided with a shaft sleeve having a tapered hole slidably mounted with a main shaft rod having an axial sliding slot, and the shaft sleeve being mounted with a positioning rod slidably mounted to the sliding slot such that the main shaft can slide up and down with respect to the shaft sleeve, and a pad being provided in between the shaft sleeve, and the main shaft rod, and the main shaft rod located at the lower section of the pad being mounted with a spring, and the bottom end of the main shaft rod being locked with a liming plate for the urging of the spring such that the main shaft rod urges at the top support rod, the top support rod pressing against the bearing of the driving structure, thereby the reciprocating-type abrasive device for a sanding machine is obtained.

2. A reciprocating-type abrasive device for a sanding machine as set forth in claim 1, wherein the bottom surface of the support frame is provided with a fixing board having an opening allowing the passage of the driven roller, and the two lateral sides of the opening on the bottom surface of the fixing board are provided with two shaft frames to allow the fastening of the reciprocating abrasive device.

3. A reciprocating-type abrasive device for a sanding machine as set forth in claim 1, wherein the driving structure is a servomotor mounted with a housing, and within the housing, a worm is connected to the servomotor, the side of the housing is mounted with a lateral covering plate which can be mounted to the fixing rod, in between the lateral covering plate and the housing, a worm gear is mounted by means of a bearing, and the worm gear is engaged with the worm, and the main shaft is connected to the worm via the lateral covering plate.

4. A reciprocating-type abrasive device for a sanding machine as set forth in claim 1 or 3, wherein the free end of the main shaft is mounted with a shaft sleeve and the end face of the shaft sleeve is formed into an eccentric protrusion.

5. A reciprocating-type abrasive device for a sanding machine as set forth in claim 1, wherein the seat body of the reciprocating structure is provided with a mounting sleeve to facilitate the effectiveness of sliding of the top support rod.

6. A reciprocating-type abrasive device for a sanding machine as set forth in claim 1 or 5, wherein the top end of the top support rod of the reciprocating structure is mounted with a bearing by screw bolts, and the bearing is provided with a sliding sleeve so as to reduce frictional force of the top support rod and the main shaft rod.

7. A reciprocating-type abrasive device for a sanding machine as set forth in claim 1, wherein the external edge of the shaft sleeve of the reciprocating structure has an edge to allow the shaft sleeve to be mounted to the driven roller by screw bolts.

8. A reciprocating-type abrasive device for a sanding machine as set forth in claim 1, wherein the external edge of the main shaft rod of the reciprocating structure has a larger sliding rod section and the sliding slot is located on the sliding rod section.

* * * * *